US008292389B2

(12) United States Patent
Kuno

(10) Patent No.: US 8,292,389 B2
(45) Date of Patent: Oct. 23, 2012

(54) RECORDING CONTROL SYSTEM

(75) Inventor: Masashi Kuno, Obu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 326 days.

(21) Appl. No.: 12/711,242

(22) Filed: Feb. 23, 2010

(65) Prior Publication Data

US 2010/0214336 A1 Aug. 26, 2010

(30) Foreign Application Priority Data

Feb. 25, 2009 (JP) ..... 2009-042814

(51) Int. Cl.
*B41J 29/38* (2006.01)
*B41J 2/21* (2006.01)

(52) U.S. Cl. ..... 347/12; 347/43

(58) Field of Classification Search ..... 347/43–44, 347/11–12

See application file for complete search history.

(56) References Cited

U.S. PATENT DOCUMENTS

| | | | | |
|---|---|---|---|---|
| 2001/0024218 | A1 | 9/2001 | Inui et al. | |
| 2002/0158942 | A1* | 10/2002 | Kaneko et al. | 347/43 |
| 2002/0171709 | A1 | 11/2002 | Teshigawara et al. | |
| 2006/0227238 | A1 | 10/2006 | Kuroki et al. | |

FOREIGN PATENT DOCUMENTS

| | | | |
|---|---|---|---|
| JP | H10-157087 | A | 6/1998 |
| JP | 2000-190470 | A | 7/2000 |
| JP | 2001-180017 | A | 7/2001 |
| JP | 2001-180018 | A | 7/2001 |
| JP | 2002-248798 | A | 9/2002 |
| JP | 2003-034021 | A | 2/2003 |
| JP | 2004-050705 | A | 2/2004 |
| JP | 2004-249469 | A | 9/2004 |
| JP | 2006-293009 | A | 10/2006 |

OTHER PUBLICATIONS

Japan Patent Office, Office Action for Japanese Patent Application No. 2009-042814, mailed Dec. 14, 2010.

Japan Patent Office, Office Action for Japanese Patent Application No. 2009-042815 (counterpart to co-pending U.S. Appl. No. 12/710,761), mailed Dec. 14, 2010.

* cited by examiner

*Primary Examiner* — Jason Uhlenhake
(74) *Attorney, Agent, or Firm* — Baker Botts L.L.P.

(57) ABSTRACT

In a recording control system, representative pixels are set as a part of the pixels in the detection region. The determining unit determines whether a pixel value of the selected at least one representative pixel falls within a first pixel value range. The recording head ejects ink based on pixel data in the first region while scanning in the first direction. The recording head ejects ink based on pixel data in the second region adjacent to the first region while scanning in the first direction when the pixel value of the selected at least one representative pixel falls within the first pixel value range. The recording head ejects ink based on pixel data in the second region while scanning in the second direction when the pixel value of at least one of the selected at least one representative pixel does not falls within the first pixel value range.

13 Claims, 13 Drawing Sheets

RECORDING CONTROL SYSTEM

CROSS REFERENCE TO RELATED APPLICATION

This application claims priority from Japanese Patent Application No. 2009-042814 filed Feb. 25, 2009. The entire content of the priority application is incorporated herein by reference.

TECHNICAL FIELD

The present invention relates to a recording control system for controlling inkjet record.

BACKGROUND

An inkjet recording device provided with a recording head having a plurality of nozzle rows corresponding to a plurality of ink colors is well known in the art. The device records an image represented in image data by reciprocating the recording head while ejecting ink from the nozzle rows based on the image data.

In order to improve the speed at which images are recorded, this type of inkjet recording device may perform bi-directional recording in which an image is recording by ejecting ink from the recording head in both a forward direction and a reverse direction of the reciprocal motion. Here, the different sequences in which the colors of ink are superposed between the forward scan and reverse scan can lead to irregularities in color (referred to as "color banding"). However, since the degree in which such color banding is noticeable depends on the image, a method has been proposed for recording areas of an image in which color banding would be more noticeable by single-direction recording.

Specifically, for each region of an image that is recorded in either one forward scan or one reverse scan of the recording head (hereinafter referred to as a "scanning region"), the conventional recording device employing the above method determines whether the image in any portion of this scanning region is susceptible to noticeable color banding. The device performs bi-directional recording when determining that the scanning region has no areas in which color banding is noticeable, and performs single-direction recording when determining that the scanning region has areas in which color banding may be noticeable. More specifically, the recording device scans the image data within two detection areas (windows) of the scanning region to detect an image with a high quantity of ink (a high recording duty) and calculates the ink quantity within the detection areas at each scanning position of the window. Based on these calculations, the recording device performs bi-directional recording when there exists no detection areas having an ink quantity greater than a reference value and performs single-direction recording when there exists even one such detection area.

SUMMARY

However, in order to calculate a characteristic value (ink quantity in this example) of an image in the detection area, the conventional inkjet recording device described above requires a longer process time.

In view of the foregoing, it is an object of the present invention to provide a recording control system capable of reducing the process time required to prevent color banding caused by colors of ink being superposed in a different order. In order to attain the above and other objects, the invention provides a recording control system. The recording control system controls an inkjet recording operation for recording an image by controlling a recording head based on image data indicating the image. The recording head has a plurality of nozzle rows and being configured to be capable of scanning in a first direction and a second direction opposite to the first direction. The plurality of nozzle rows corresponds to a plurality of colors. Each nozzle row includes a plurality of nozzles that are arranged in a direction intersecting with the first and second directions and that are configured to eject ink of corresponding color. The image includes a plurality of pixels. The image data has a plurality of sets of pixel data corresponding to the plurality of pixels. Each set of pixel data includes a pixel value representing color of a corresponding pixel. The pixel value indicates a hue value representing hue of the color of the corresponding pixel and a brightness value representing brightness of the color of the corresponding pixel. The recording control system includes a setting unit, a selecting unit, a determining unit, and a control unit. The setting unit sets, in the image, a first region and a second region adjacent to the first region, sets a detection region in one of the first and second regions, and sets a plurality of representative pixels in the detection region. The plurality of representative pixels are a part of the pixels in the detection region. A number of the plurality of representative pixels is smaller than a total number of the pixels existing in the detection region. The selecting unit selects at least one representative pixel among the representative pixels. The determining unit determines whether a pixel value of the selected at least one representative pixel falls within a first pixel value range. The control unit controls the recording head to eject ink based on pixel data corresponding to pixels in the first region while controlling the recording head to scan in the first direction such that the recording head records the image in the first region. The control unit controls the recording head to eject ink based on pixel data corresponding to pixels in the second region while controlling the recording head to scan in the first direction such that the recording head records the image in the second region when the determining unit determines that the pixel value of the selected at least one representative pixel falls within the first pixel value range. The control unit controls the recording head to eject ink based on pixel data corresponding to pixels in the second region while controlling the recording head to scan in the second direction such that the recording head records the image in the second region when the determining unit determines that the pixel value of at least one of the selected at least one representative pixel does not falls within the first pixel value range.

BRIEF DESCRIPTION OF THE DRAWINGS

The particular features and advantages of the invention as well as other objects will become apparent from the following description taken in connection with the accompanying drawings, in which:

FIG. 8(*b*) is an explanatory diagram illustrating a method to randomly reduce the number of representative pixels;

FIG. 11(*b*) is an explanatory diagram illustrating another example of erroneous judgment when the determination method shown in FIG. 10 is performed;

FIG. 12(*b*) is an explanatory diagram illustrating an example of erroneous judgment when the determination method shown in FIG. 12(*a*) is performed;

FIG. 14(*b*) is an example of a detection block in which representative pixels are arranged in a V-shaped layout;

FIG. 14(*c*) is an example of a detection block in which representative pixels are arranged in a X-shaped layout;

DETAILED DESCRIPTION

1. First Embodiment

A communication system 100 according to a first embodiment will be described.

1-1. Overall Structure of the Communication System 100

Figure 1:
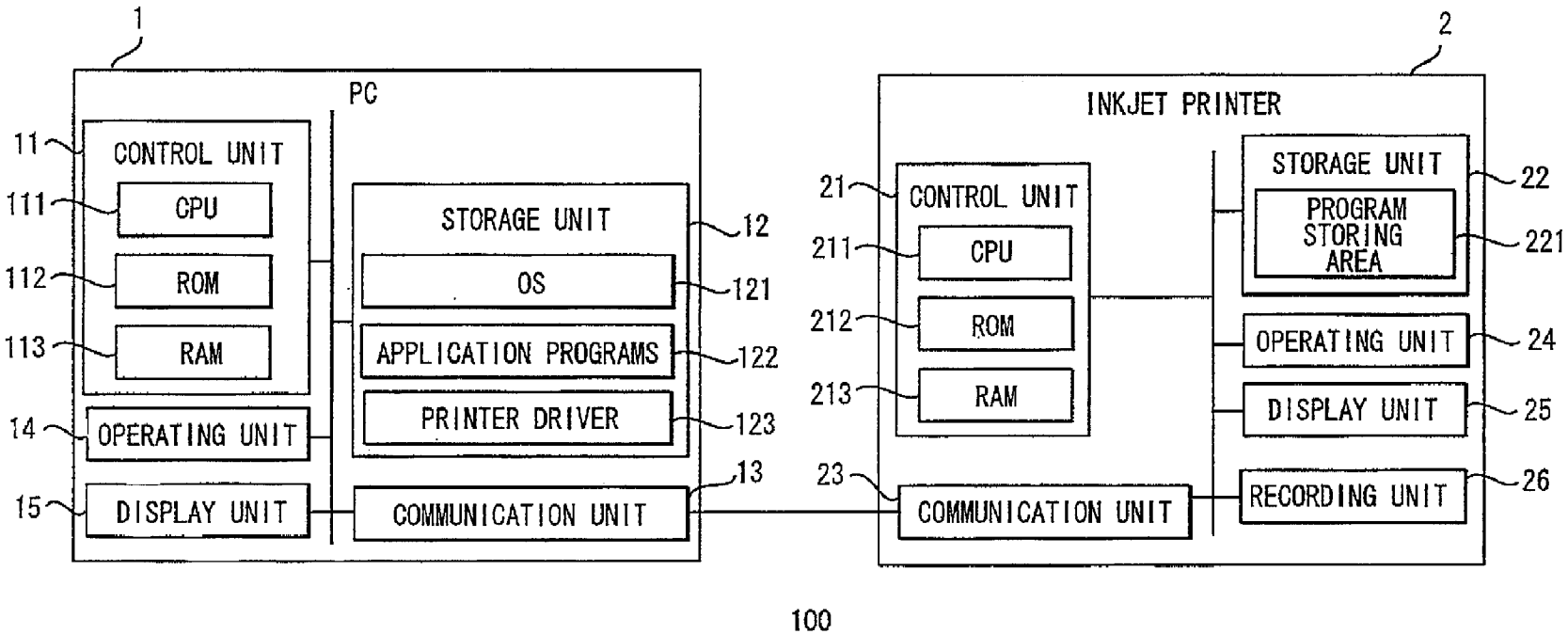
FIG. 1 is a block diagram showing an overall structure of a communication system according to a first embodiment.

FIG. 1 is a block diagram showing the overall structure of the communication system 100 according to the first embodiment. As shown in FIG. 1, the communication system 100 includes a personal computer (PC) 1 and an inkjet printer 2.

The PC 1 is a data processor that includes a control unit 11, a storage unit 12, a communication unit 13, an operating unit 14, and a display unit 15.

The control unit 11 comprehensively controls each unit in the PC 1. The control unit 11 includes a CPU 111, a ROM 112, and a RAM 113.

The storage unit 12 is a nonvolatile storage device that allows stored data to be overwritten. In the embodiment, a hard disk drive is used as the storage unit 12. Various programs are installed on the storage unit 12, including an operating system (OS) 121, application programs 122 such as an image-browsing program, and a printer driver 123, which is a software program that enables the PC 1 to use the inkjet printer 2.

The communication unit 13 is an interface for performing data communications with the inkjet printer 2.

The operating unit 14 is an input device that enables a user to input commands through external operations. In the embodiment, a keyboard and a pointing device such as a mouse or a touchpad are used as the operating unit 14.

The display unit 15 is an output device for displaying various data to the user as visible images. In the embodiment, a liquid crystal display is used as the display unit 15.

The inkjet printer 2 is an inkjet type recording device (printer) and includes a control unit 21, a storage unit 22, a communication unit 23, an operating unit 24, a display unit 25, and a recording unit 26.

The control unit 21 comprehensively controls each unit in the inkjet printer 2. The control unit 21 includes a CPU 211, a ROM 212, and a RAM 213.

The storage unit 22 is a nonvolatile storage device that allows storage data to be overwritten. In the embodiment, flash memory is used as the storage unit 22. The storage unit 22 includes a program storing area 221 that stores a recording control program that the CPU 211 executes in order to perform a recording control process described later.

The communication unit 23 is an interface for implementing data communications with the PC 1.

The operating unit 24 is an input device that allows a user to input commands through external operations. The operating unit 24 includes various operating buttons.

The display unit 25 is an output device for displaying various data to the user as visible images. In the embodiment, a small liquid crystal display is used as the display unit 25.

The recording unit 26 functions to record (print) color images by ejecting ink droplets in the colors cyan (C), magenta (M), yellow (Y), and black (K) onto paper or another recording medium.

Figure 2:
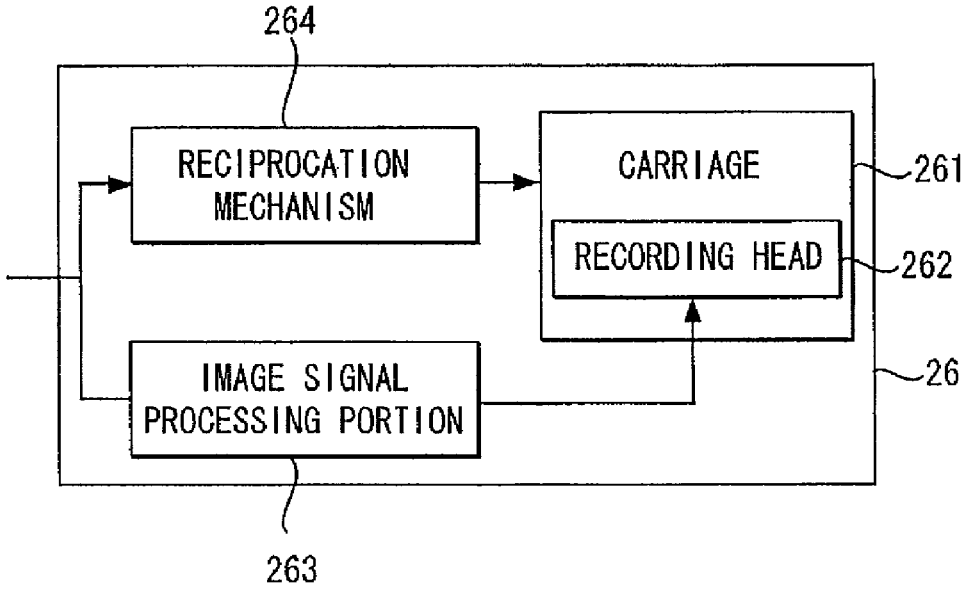
FIG. 2 is an enlarged view of a recording unit shown in FIG. 1.

More specifically, as shown in FIG. 2, the recording unit 26 includes a carriage 261, an image signal processing portion 263, and a reciprocation mechanism 264. The carriage 261 mounts a recording head 262. The reciprocation mechanism 264 moves the carriage 261 to reciprocate in a main scanning direction orthogonal to the paper conveying direction (sub-scanning direction). According to the reciprocation of the carriage 261, the recording head 262 reciprocates over a paper-conveying path along which sheets of paper are conveyed. The image signal processing portion 263 receives image signal from the control unit 21 and generates a control signal to control the recording head 262 and the reciprocation mechanism 264 based on the image signal. Here, the control unit 21 generates the image signal based on the image data.

Figure 3:
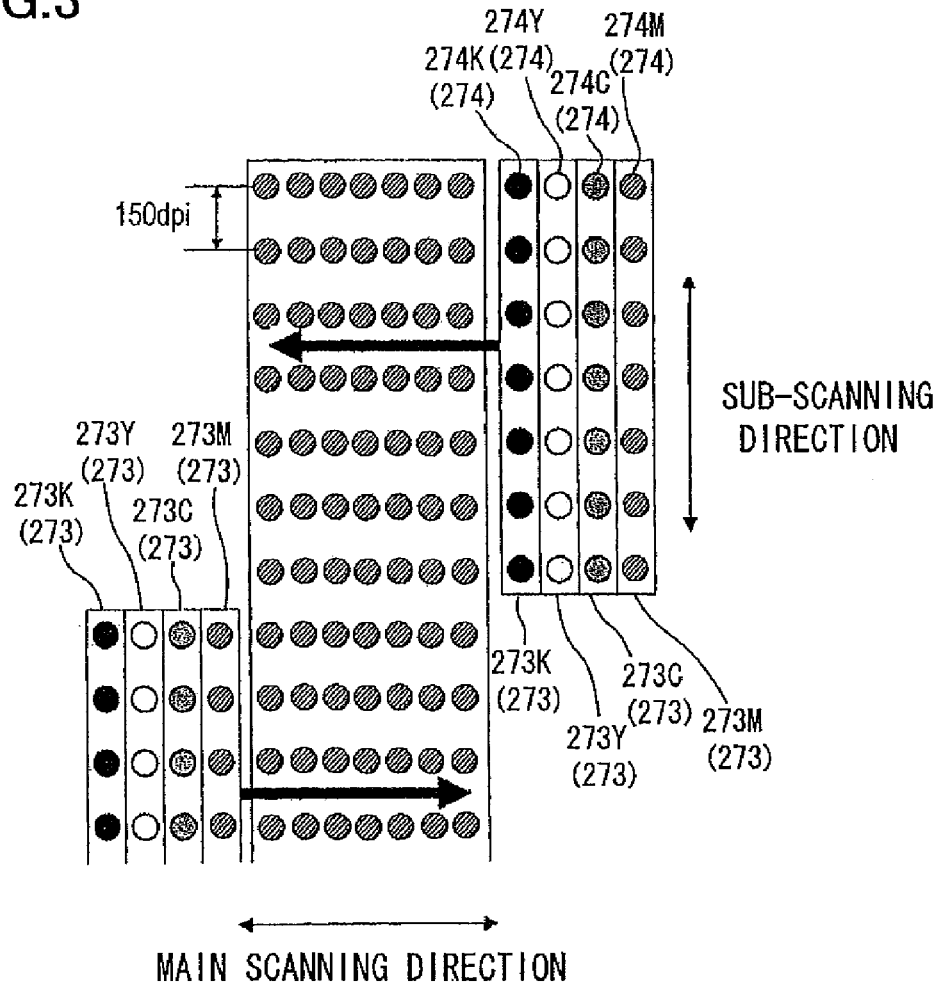
FIG. 3 is an explanatory diagram illustrating a configuration of a recording head.

As shown in FIG. 3, a plurality of nozzles 274 for ejecting ink is formed in the bottom surface of the recording head (the surface opposing the conveyed sheets of paper). The nozzles 274 (274C, 274M, 274Y, and 274K) are arranged in each of four nozzle rows 273 (273C, 273M, 273Y, and 273K). That is, each nozzle row 273 corresponding color (one of C, M, Y, and K colors) extends in the sub-scanning direction and the nozzles 274 for the corresponding color arranged in the sub-scanning direction. Four nozzle rows 274 are arranged in the main scanning direction and juxtaposed in the sub-scanning direction. In other words, nozzles 273 within the same nozzle row 274 eject ink of the same color. Specifically, the nozzles are arranged in nozzle rows 273 for ejecting ink in the respective colors C, M, Y, and K.

The recording unit 26 records an image represented by image data on paper by reciprocating the recording head 262 in the main scanning direction while ejecting ink droplets from nozzles in the nozzle rows 272C, 272M, 272Y, and 272K based on the image data. More specifically, image signal processing portion 263 performs an ink droplet control based on, the control signal generated from the image signal. In the embodiment, the image signal includes multiple levels information (more than two levels information) indicating size of dot to be dropped, in order to render color shades more naturally. In the embodiment, by adjusting the quantity of the ink ejected among a plurality of levels, the recording unit 26 can render each pixel in four levels: no dot, small dot, medium dot, and large dot.

1-2. Overview of the Image Process

Next, an overview of the image process executed on the communication system 100 according to the first embodiment will be described.

The printer driver 123 is launched when the user of the PC 1 performs an operation in a running application to initiate a printing operation. The printer driver 123 sequentially transmits image data for the print job (in the embodiment, 256-level image data expressed in the RGB color spade) to the inkjet printer 2 in units of scanning regions, each scanning region including a plurality of recording lines.

Figure 4:
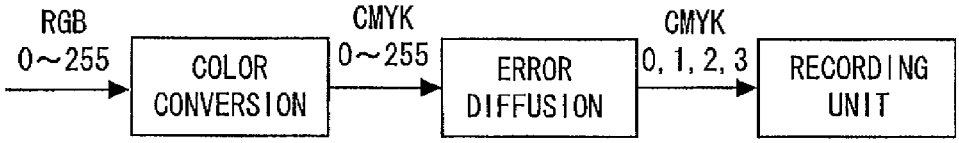
FIG. 4 is an explanatory diagram illustrating a conversion process performed in an inkjet printer.

As shown in FIG. 4, the inkjet printer 2 performs a color conversion process on the 256-level RGB data received from the PC 1. The color conversion process is performed to convert the RGB data to image data in the CMYK color space corresponding to the colors of ink used in the inkjet printer 2. Next, the inkjet printer 2 performs a halftone process (error diffusion process in the embodiment) on the 256-level CMYK image data produced from the above color conversion process in order to reduce the number of levels in the image data to four levels. The four-level CMYK data produced from this halftone process has level values that express a dot size (that is corresponding to an amount of ink to be dropped from the nozzle 274) for each color of each pixel in the image.

When this four-level CMYK image data is outputted to the recording unit 26, the recording unit 26 prints an image expressed by the image data on paper by ejecting ink based on the image data.

Figure 5:
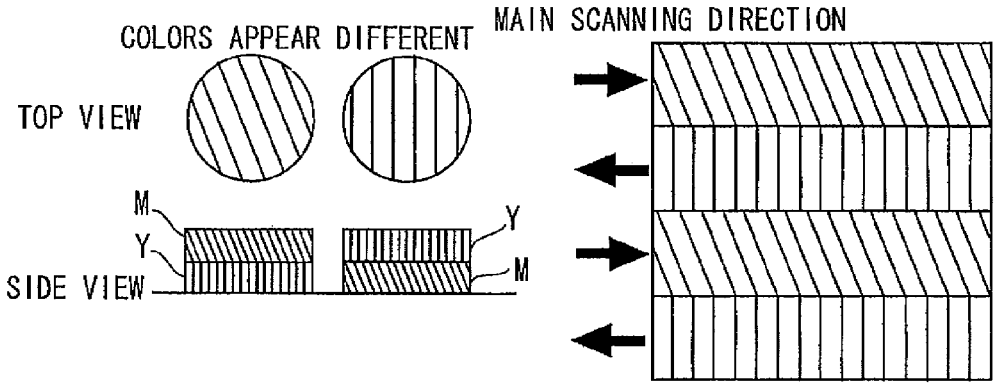
FIG. 5 is an explanatory diagram illustrating banding in an image.

Inkjet recording is performed bi-directionally, whereby ink is ejected while scanning the recording head 262 in both forward and reverse directions. Particularly, when performing bi-directional recording in which the recording head 262 alternately repeats one-pass forward recording and one-pass reverse recording, to record recording lines in the main scanning direction, the colors produced on the paper often differ between the forward scan and the reverse scan because, as illustrated in FIG. 5, the order in which the colors of ink are superposed differs. Thus, despite printing the same color based on the image data, the color may appear different depending on the scanning direction. Such color differences produced on paper are less noticeable in images (objects such as graphics and text) that fit within a single scanning region, but are more noticeable in images formed across a plurality of scanning regions due to the occurrence of color banding (hereinafter simply referred to as "banding"). Such banding becomes more noticeable as the size of the image increases.

The degree to which banding is noticeable also depends on the color of the image. A solid image (or near-solid image) formed of a single color is particularly susceptible to noticeable banding. However, yellow images or images of a color formed primarily using black tend not to produce noticeable banding, even for solid images.

Figure 6:
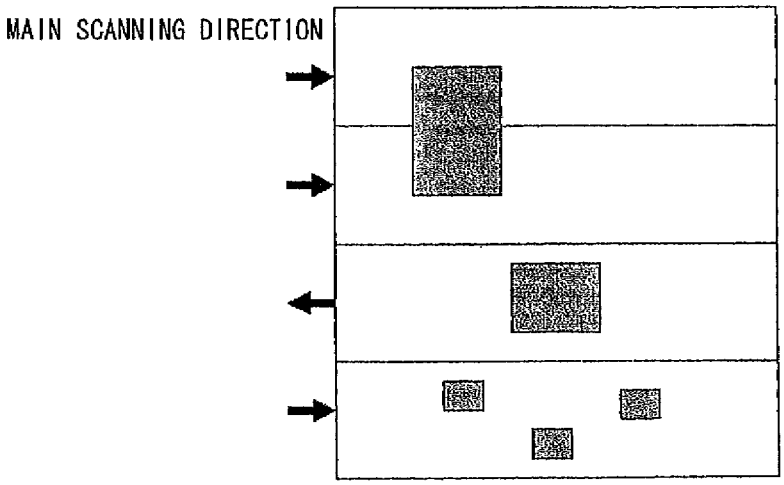
FIG. 6 is an explanatory diagram illustrating recording operation in which the recording head scans successive two scanning regions in a same direction.

In the inkjet printer 2 according to the embodiment, the conditions defining an image with noticeable banding (hereinafter referred to as a "banding image") are (1) an image greater than or equal to a reference size that is present in one scanning area (an $N^{th}$ scanning region) and adjacent to the border with the next scanning region to be recorded (an $(N+1)^{th}$ scanning region), (2) the image is configured only of pixels having substantially the same color, and (3) the color is not a color for which banding is not easily noticeable (that is, the color of the image is a color for which banding is easily noticeable). Based on these conditions, the inkjet printer 2 determines for each scanning region whether a banding image exists in the scanning region and performs single-direction recording in which two scanning areas adjacent each other are recorded with the recording head 262 moving in the same direction, to prevent such banding when determining that a banding image exists. Hence, as illustrated in FIG. 6, the inkjet printer 2 performs single-direction recording only in areas where banding will be noticeable.

Figure 7:
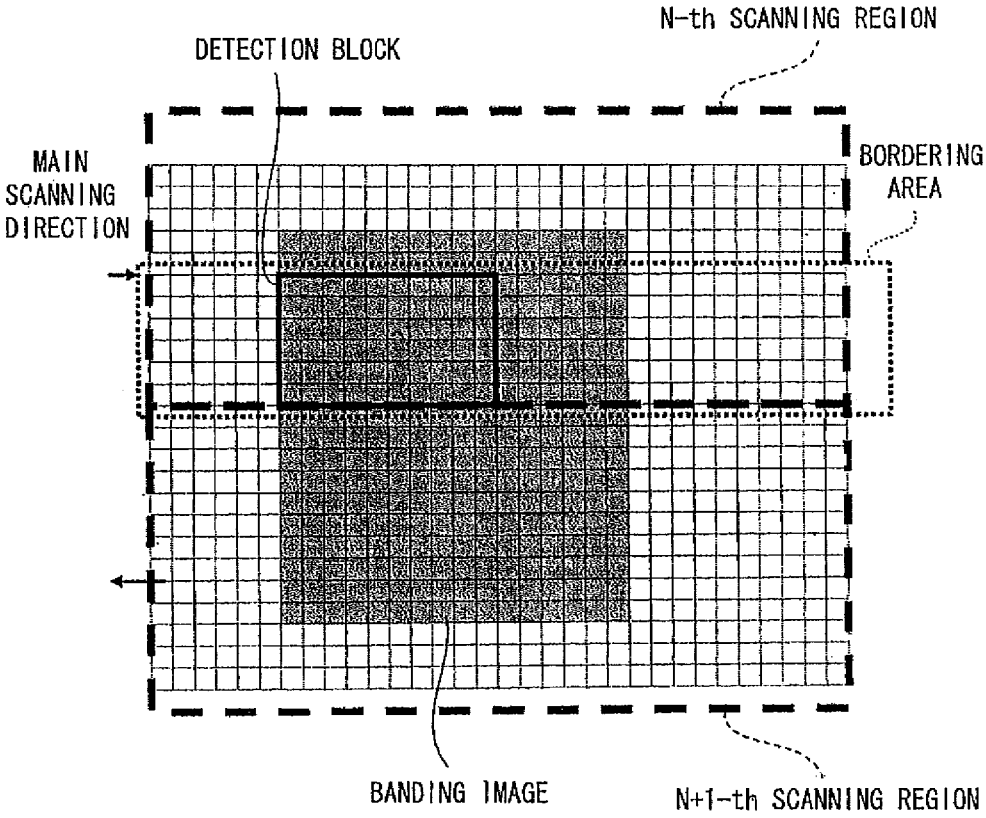
FIG. 7 shows a detection block set to a sample reference size.

In the above conditions, the "reference size" is an image size (defined for both horizontal and vertical dimensions) set to values predetermined in visual experiments for indicating that images of the same size or larger are susceptible to noticeable banding. FIG. 7 shows a detection block set to a sample reference size of 10 pixels horizontally by 6 pixels vertically. The reference size may be set such that a square or rectangle measuring 2-3 millimeters per side. In this case, since 3 millimeters is equivalent to 70 pixels when printing at 600 dpi resolution, it is necessary to reference pixel values for 4,900 pixels if the reference size is set to 3 $mm^2$.

When detecting banding images in an $N^{th}$ scanning region having a rectangular shape, the inkjet printer 2 performs detections in a plurality of detection blocks (only one is shown in FIG. 7) having the same size as the reference size so as to cover the entire length of the $N^{th}$ scanning region in the main scanning direction along the border with the $(N+1)^{th}$ scanning region, as shown in FIG. 7. That is, the inkjet printer 2 divides the $N^{th}$ scanning region into the plurality of detection blocks having rectangular shape. The plurality of detection blocks are arranged in the main scanning direction. In the embodiment, bottom side of the detection block coincides with the border line between the $N^{th}$ scanning region and the $(N+1)^{th}$ scanning region. The inkjet printer 2 determines that a banding image exists in the scanning region (the $N^{th}$ scanning region in this case) when even one of the plurality of detection blocks therein meets the above banding image conditions (that the image includes only pixels of substantially the same color and that the color is a color for which banding is noticeable). Through these determinations, the inkjet printer 2 can prevent banding by controlling the recording unit 26 to record the $(N+1)^{th}$ scanning region in the same scanning direction as the $N^{th}$ scanning region. In other words, the inkjet printer 2 detects a banding image by referencing pixels within a band-like region having the same vertical and horizontal dimensions as the reference size and positioned in the area of the $N^{th}$ scanning region that borders the $(N+1)^{th}$ scanning region (hereinafter this band-like region will be referred to as a "bordering area").

In a conceivable case when referencing all pixels within detection blocks to determine whether a banding image is present, the inkjet printer 2 ends up referencing all pixels within the entire bordering area when a banding image is not found, requiring a lengthy process time and increasing the amount of memory required for processing.

Figure 8A:
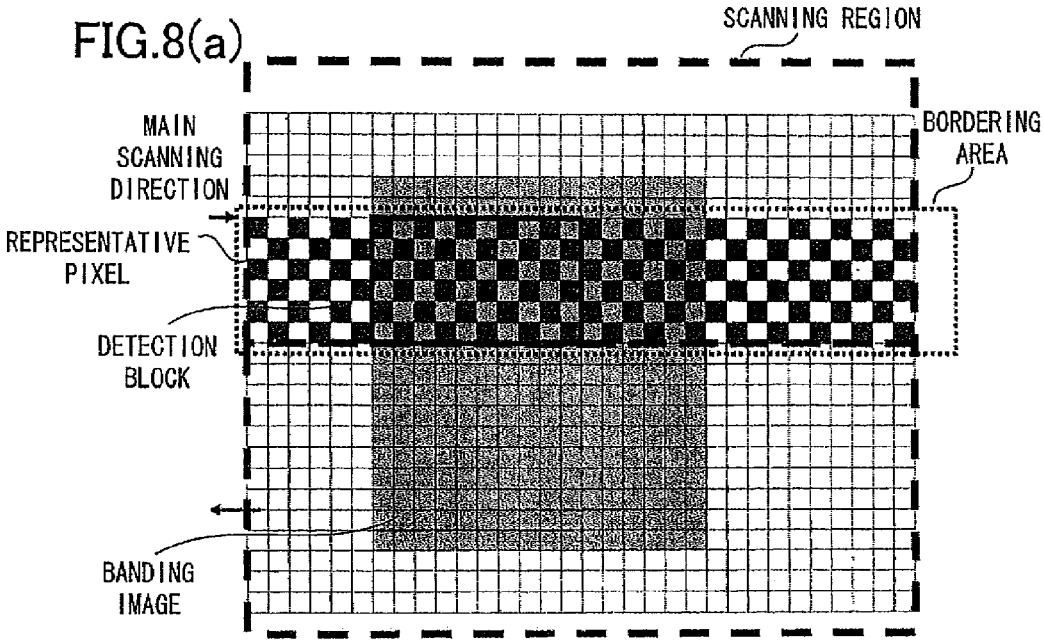
FIG. 8(*a*) is an explanatory diagram illustrating a method to reduce the number of representative pixels.
Figure 8B:
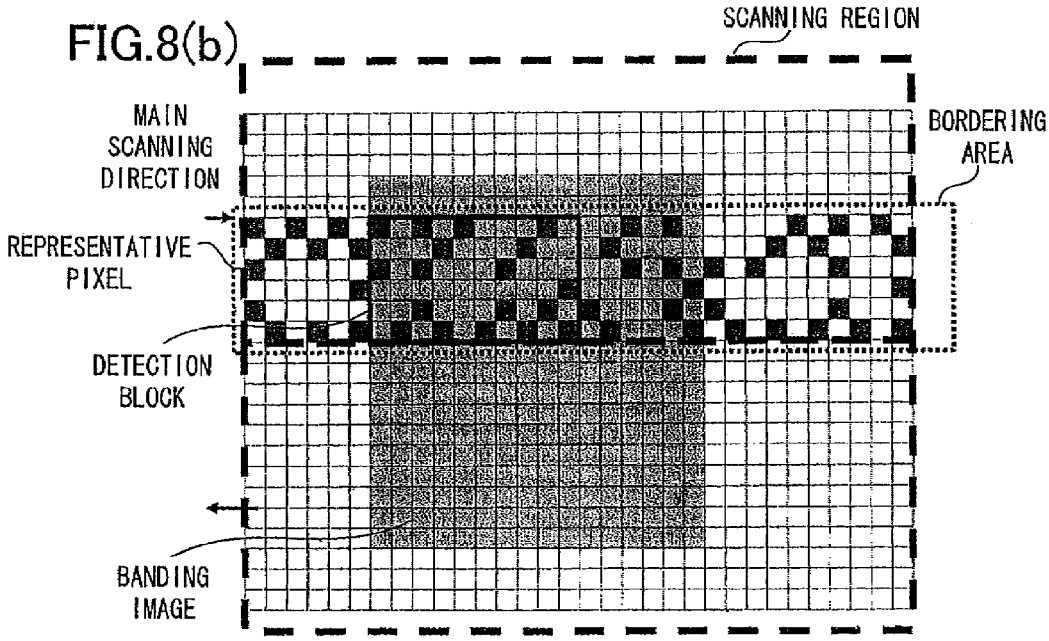

In order to reduce this process time, it is possible to reference just a portion of pixels in each detection block as representative pixels, rather than referencing all pixels. In other words, the inkjet printer 2 skips pixels within each detection block to reduce the number of pixels that are referenced. One possible method of skipping pixels uses the principles of ordered dithering that applies a checkerboard pattern, random pattern, or Bayer matrix, for example, to skip pixels in each detection block. When skipping pixels according to a checkerboard pattern, it is possible to reduce the number of referenced pixels by half, as illustrated in FIG. 8(*a*). When skipping pixels randomly, as in the example shown in FIG. 8(*b*), it is possible to skip any arbitrarily set number of pixels.

Figure 9:
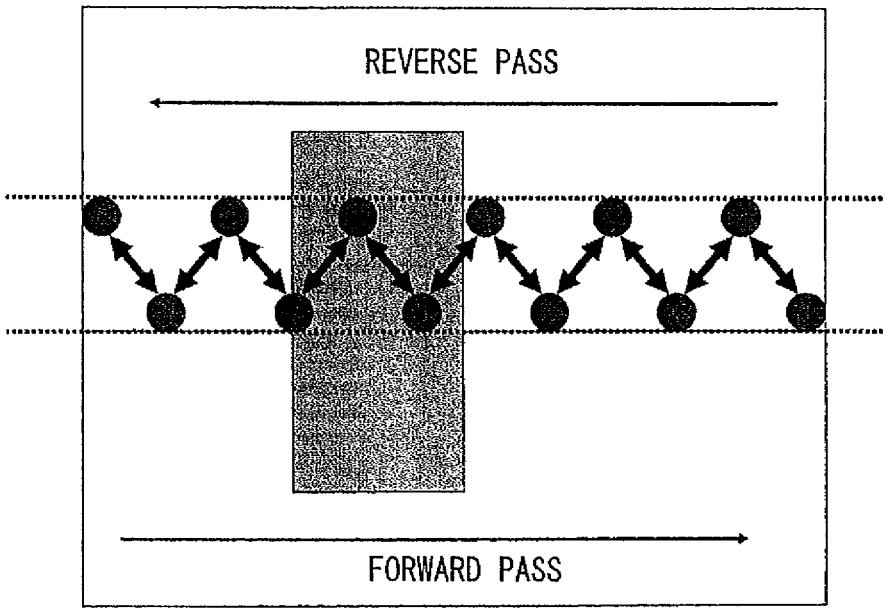
FIG. 9 is an explanatory diagram illustrating a determination method to determine a presence of a banding image by comparing pixel values for pairs of points.

For minimizing the process time, it is possible to maximize the number of skipped pixels, i.e., minimize the number of representative pixels. With this in mind, as shown in FIG. 9, it is possible to determine the presence of a banding image simply by comparing pixel values for pairs of points arranged along a diagonal. Specifically, representative pixels can be arranged in a zigzag pattern within the bordering area so that points in each neighboring pair are separated from each other both vertically and horizontally, as in the positional relationship of two opposing corners of a rectangle formed at the reference size (positions farthest from each other within a rectangle of the reference size).

When the pixel values at two diagonally opposing points among the representative pixels in this zigzag layout meet the conditions for a banding image (i.e., when the points are configured only of pixels having substantially the same color and are not a color for which banding is unnoticeable), the inkjet printer 2 can assume these conditions have been met for all pixels within a region of the reference size formed with these two points serving as endpoints of a diagonal and can determine that a banding image exists in the corresponding scanning region. In other words, by arranging representative pixels at diagonals to each other, the inkjet printer 2 can simultaneously determine the degree of color uniformity in both vertical and horizontal directions for an image within a region defined by two representative pixels serving as endpoints of a diagonal.

Figure 10:
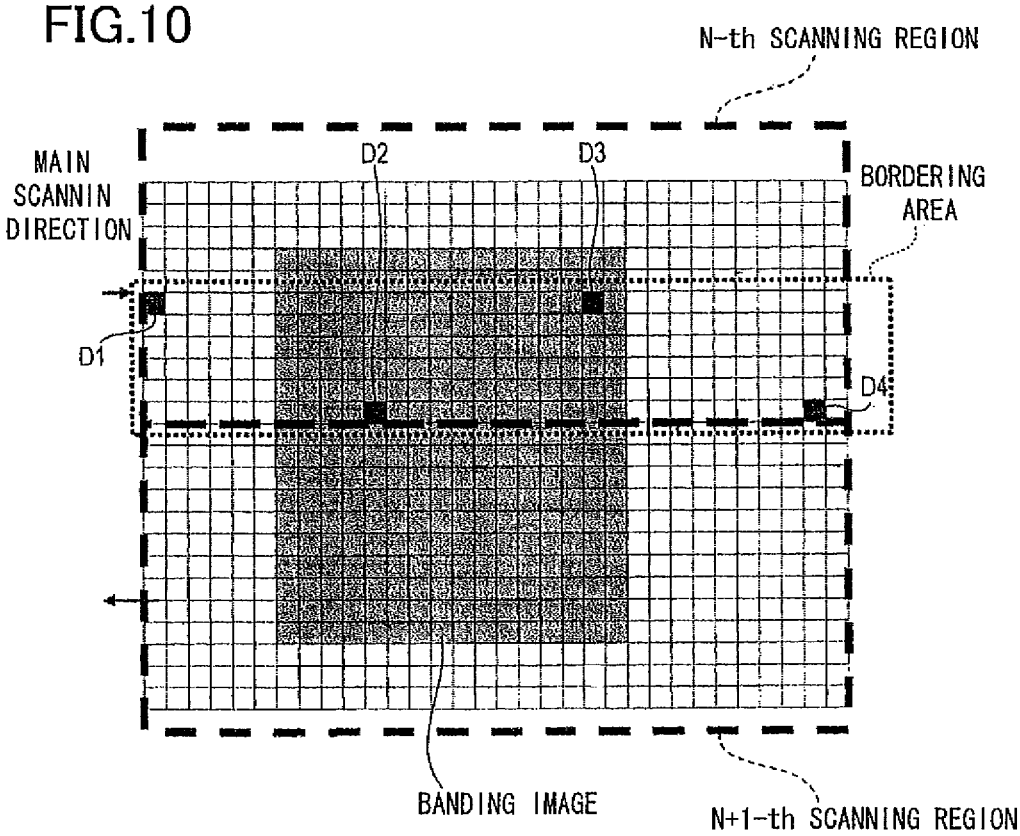
FIG. 10 is an explanatory diagram illustrating a concrete determination method to determine a presence of a banding image by comparing pixel values for pairs of points.

In the example shown in FIG. 10, four representative pixels D1-D4 are arranged in a zigzag pattern within a 31-pixel (horizontal)×6-pixel (vertical) region of a bordering area. That is, the four representative pixels D1-D4 are discretely positioned in the bordering area. Here, the inkjet printer 2 determines a presence of a banding image by respectively comparing pixels D1 and D2, pixels D2 and D3, and pixels D3 and D4. When determinations are performed in order beginning from the leftmost pair of pixels D1 and D2, the inkjet printer 2, in this example, detects a banding image in the second determination (D2 and D3), that is, the inkjet printer 2 anticipates that the banding image exists. Even in cases that a banding image is not detected, the inkjet printer 2 need only perform remaining three determinations. In other words, the inkjet printer 2 can determine the presence of a banding image in just three determinations for a 186-pixel (31-pixel (horizontal)×6-pixel (vertical)) region. Moreover, this method eliminates the need to increase the number of determinations when the bordering area is expanded somewhat in the vertical and horizontal directions.

Figure 11A:
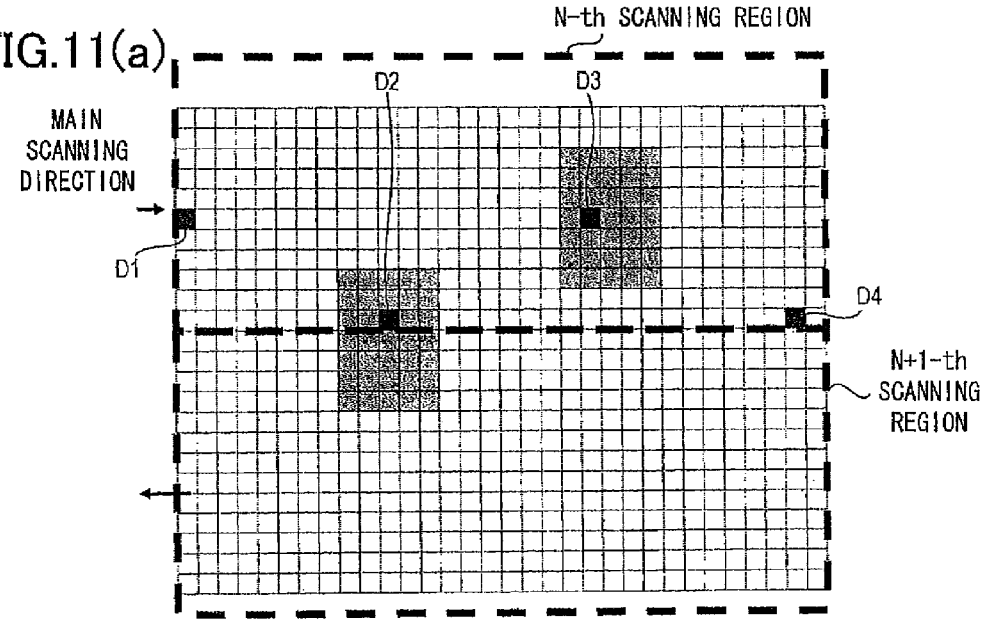
FIG. 11(*a*) is an explanatory diagram illustrating an example of erroneous judgment when the determination method shown in FIG. 10 is performed.
Figure 11B:
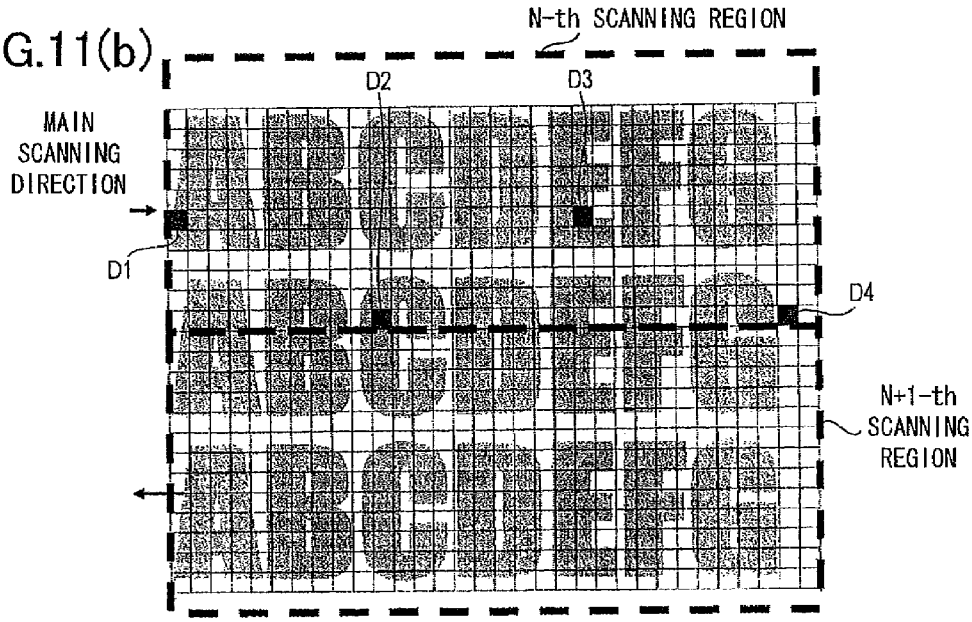

However, it is conceivable that this method may lead the inkjet printer 2 to mistake a plurality of images (objects) smaller than the reference size as a single banding image, as illustrated in the examples of FIGS. 11(*a*) and 11(*b*). A larger number of such erroneous judgments would needless increase the ratio of single-direction recording operations, reducing recording speed.

Figure 12A:
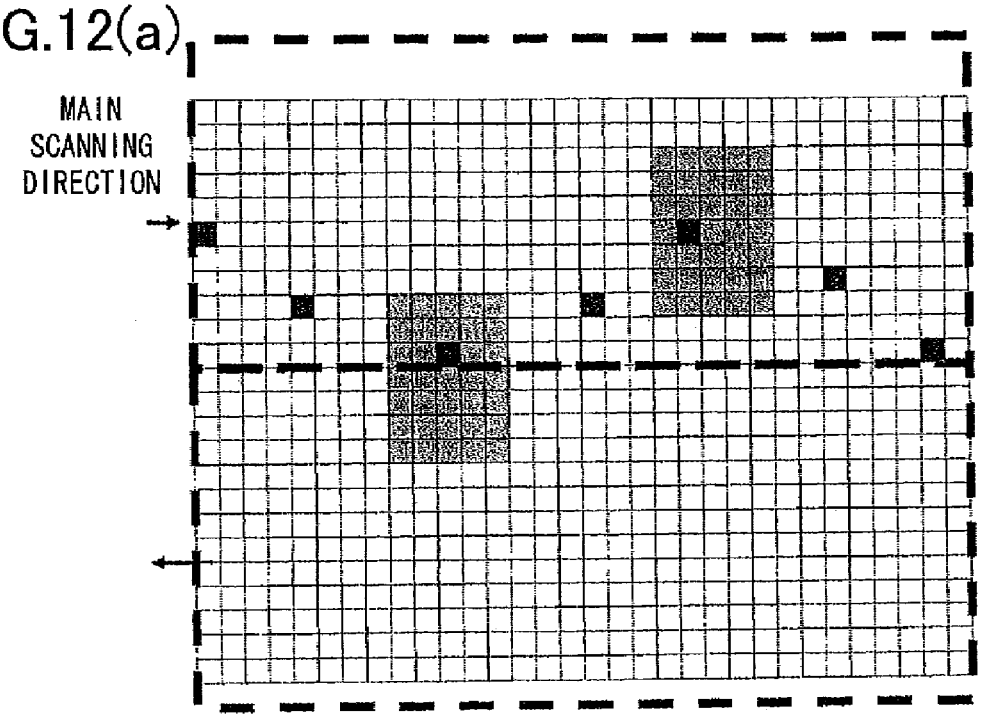
FIG. 12(*a*) is an explanatory diagram illustrating a determination method to determine a presence of a banding image by comparing pixel values for three points.
Figure 12B:
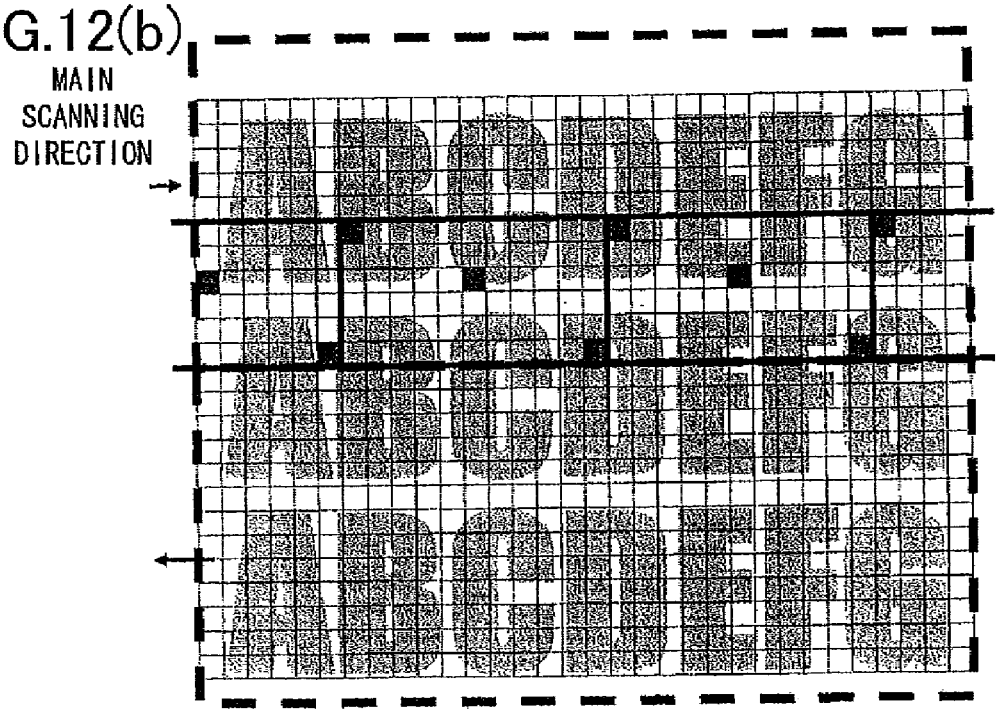

One possible method of decreasing the occurrence of such erroneous judgments is to add another representative pixel at an intermediate position between each pair of diagonally opposing pixels and to detect banding images through a comparison of three points at a time, as in the example shown in FIG. 12(*a*). While this method will lead to fewer errors than the method using two-point comparisons, the method is still susceptible to error in images having a plurality of densely packed images (objects), such as the character array shown in FIG. 12(*b*).

To summarize the above methods under consideration, it is not possible to reduce process time sufficiently when applying the method of skipping pixels in a checkerboard pattern because too many pixels are being referenced. Increasing the number of skipped pixels in a random skipping method may result in the skipping of pixels at points that are important for an accurate determination (points in the four corners, for example). Further, the potential for erroneous determinations is too high in a method that references only two points at a time.

Figure 13:
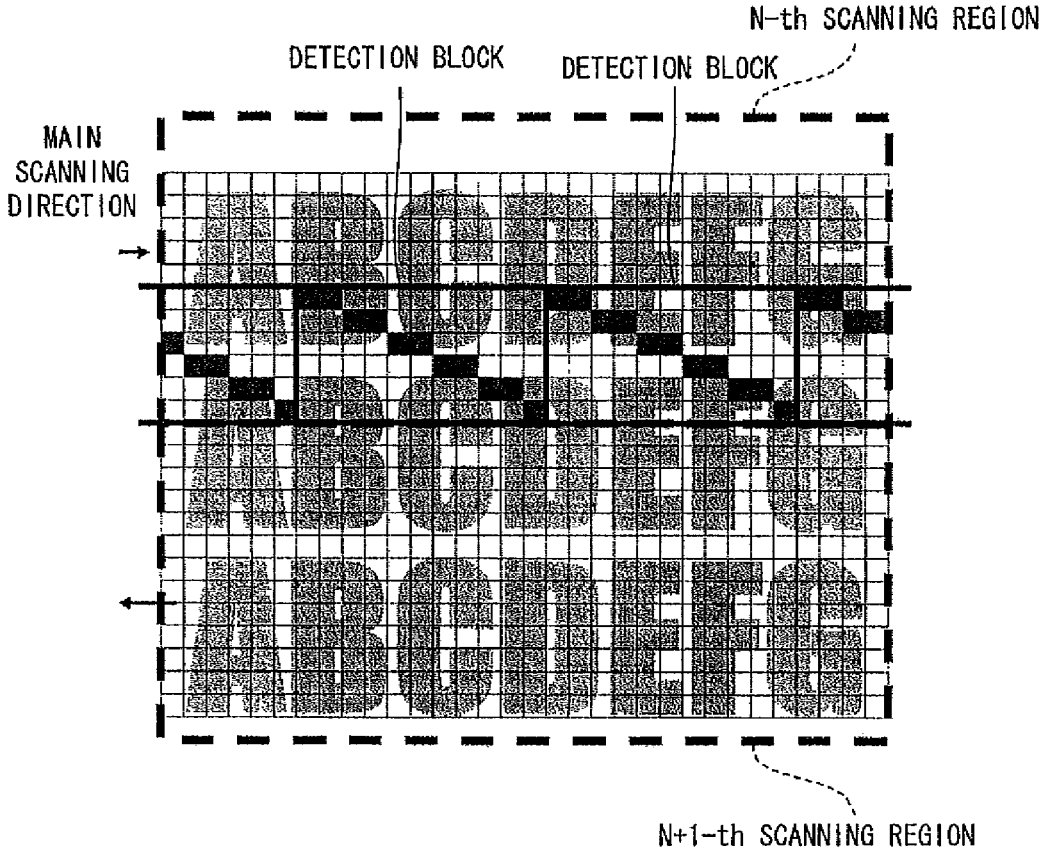
FIG. 13 is an explanatory diagram illustrating a determination method in which representative pixels are arranged along a diagonal line.

With consideration for these issues, as shown in FIG. 13, representative pixels are arranged continuously along diagonal line, as an example. This arrangement greatly reduces the potential for erroneous determinations, even in images having a plurality of densely arranged objects, such as character arrays, since the representative pixels are also positioned in spaces between characters or between lines.

The representative pixels may not necessarily need to be arranged in diagonal lines to achieve this effect. In the embodiment, the following conditions are required for the arrangement of the representative pixels: at least one representative pixel is positioned at each X coordinate and at least one representative pixel is positioned at each Y coordinate in the area targeted for banding image detection (the bordering area, and particularly the detection block when performing detections in blocks). It is likely that representative pixels can be positioned within spaces between characters and/or lines when the above conditions are satisfied. In other words, the control unit 21 sets the area targeted for banding image detection (the bordering area, or the detection block) such that the X coordinate values and the Y coordinate values of all the pixels in the detection region are in an X detection range and in a Y detection range, respectively. The control unit 21 sets the representative pixels in the area targeted for banding image detection (the bordering area, or the detection block) such that each X coordinate value in the X direction range is equal to the X coordinate value defining the position of at least one representative pixel and each Y coordinate value in the Y direction range is equal to the Y coordinate value defining the position of at least one representative pixel. Here, the number of the representative pixels is set smaller than the total number of the pixels in the detection blocks.

There are numerous arrangements of representative pixels that will meet these conditions. In the embodiment, the arrangement of the representative pixels requires that the representative pixels are distributed continuously. That is, in the embodiment, one representative pixel is located within 2 pixels from another representative pixel in the horizontal and the vertical directions in the area targeted for banding image detection (the bordering area, or the detection block). Accordingly, erroneous determinations are less likely to occur when the representative pixels are distributed continuously than when distributed discretely since the inkjet printer 2 will determine that a banding image exists when there are continuous pixels that meet the conditions of pixels constituting a banding image.

Figure 14A:
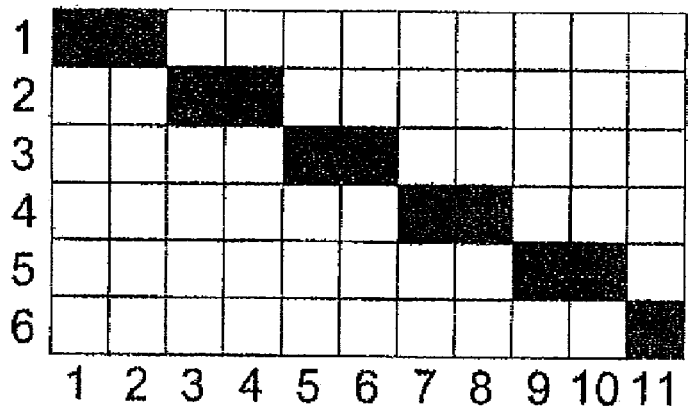
FIG. 14(*a*) is an example of a detection block in which representative pixels are arranged along a diagonal line.
Figure 14B:
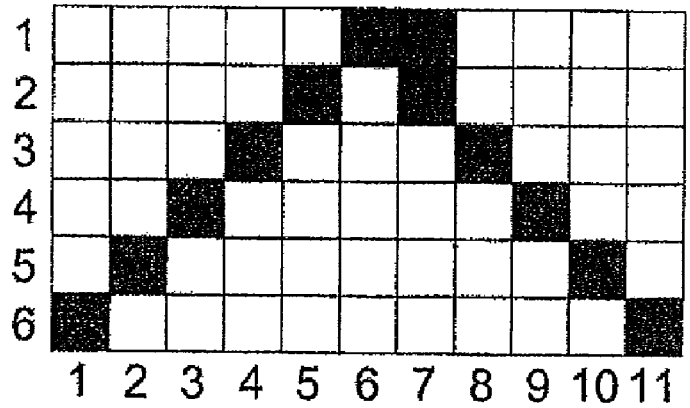
Figure 14C:
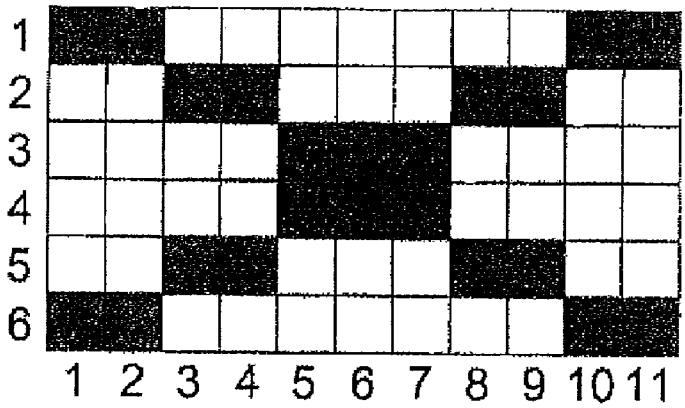

An example of representative pixels arranged continuously is a diagonal line layout, such as that shown in FIGS. 13 and 14(*a*). By arranging representative pixels continuously along a single diagonal line within the detection block (an 11-pixel (horizontal)×6-pixel (vertical) block in this example), the existence of a banding image can be determined based not only on two vertices at diagonally opposing corners of the detection block (at positions having the maximum possible separation in the detection block), but also on pixels formed continuously between these two vertices. Hence, this determination will further reduce the likelihood of erroneous detections.

Other possible arrangements of representative pixels include the inverted V-shaped layout shown in FIG. 14(*b*) and the X-shaped layout (a continuous arrangement of pixels along the two diagonals within the detection block) shown in FIG. 14(*c*). Since all four vertices of the detection block are included in determinations based on the X-shaped layout, this arrangement further reduces the likelihood of error without greatly increasing the number of representative pixels. That is, while a diagonal band-like image not wide enough to fill the detection block may be misinterpreted as a banding image when using the diagonal line layout shown in FIG. 14(*a*), the X-shaped layout shown in FIG. 14(*c*) prevents such misinterpretation. The arrangements of representative pixels shown in FIGS. 14(*a*)-14(*c*) satisfies the condition that at least one representative pixel is positioned at each X coordinate and at least one representative pixel is positioned at each Y coordinate in the area targeted for banding image detection (the bordering area and the detection block).

1-3. Detailed Description of the Process

Next, steps executed by the inkjet printer 2 for implementing the above process will be described.

Figure 15:
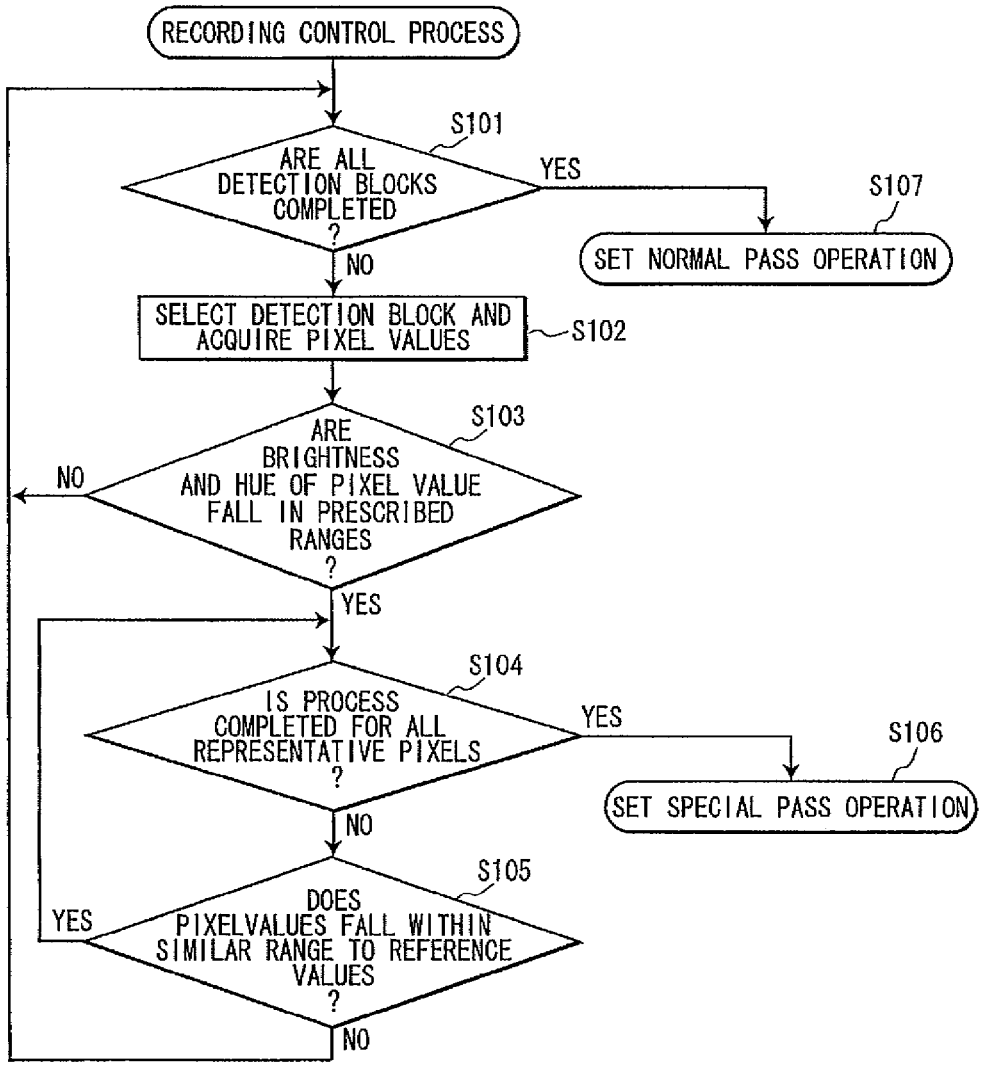
FIG. 15 is a flowchart illustrating steps in a recording control process according to the first embodiment.

FIG. 15 is a flowchart illustrating steps in a recording control process executed by the control unit 21 of the inkjet printer 2 (and specifically the CPU 211) according the recording control program when the inkjet printer 2 receives image data (256-level RGB data) in units of scanning region from the PC 1. While the following description of the recording control process is based on the representative pixels being arranged in diagonal lines, as shown in FIG. 13, a similar process is performed for other arrangements of representative pixels.

In S101 at the beginning of the recording control process, the control unit 21 determines whether the process in S102-S105 described below has been completed for all detection blocks in the targeted scanning region (the scanning region represented by the image data received from the PC 1.

If the control unit 21 determines that the following process has not been performed for all detection blocks in the current scanning region (i.e., that there remain one or more unprocessed detection blocks), the control unit 21 selects one unprocessed detection block to be subjected to the process beginning from S102.

In S102 the control unit 21 acquires pixel values (256-level RGB values) for a representative pixel positioned at the predetermined position in the detection block and sets these pixel values as reference values. In this example, the control unit 21 acquires pixel values for the top left representative pixel in the detection block and sets these pixel values as reference values to be used in the subsequent process of S105. In other words, the control unit 21 sequentially performs determination processes in the recording control process on the plurality of representative pixels arranged along the diagonal line connecting the top left vertex to the bottom right vertex. As will be described later, the control unit 21 determines that a banding image exists in the target scanning region when the initial (top left) representative pixel meets the criterion of not being a color for which banding is unnoticeable and when all remaining representative pixels have color values that fall within a similar range to the color values of the initial representative pixel (i.e., are substantially the same color).

Figure 16:
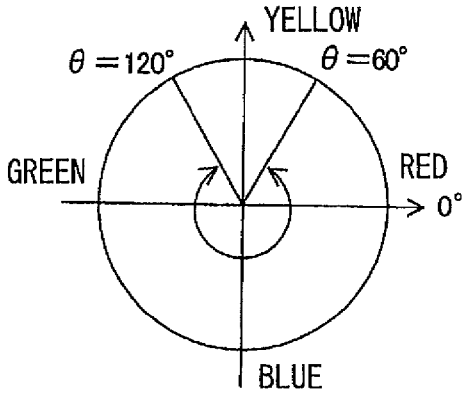
FIG. 16 is an explanatory diagram illustrating a range of hue angle representing yellow.

In S103 the control unit 21 determines whether the color values of the target pixel meet both first and second conditions, where the first and second conditions are used to determine whether the above criteria for the color values of the target pixel (top left representative pixel) not representing a color for which banding is unnoticeable (i.e., representing a color for which banding is noticeable) is satisfied. More specifically, the first condition is that the Y value (a value expressing brightness within the range 0-255) obtained by converting the RGB values of the target pixels to YCbCr values falls in the range 70-220. That is, the range 70-220 is defined as a part of a predetermined entire brightness range (0-255) that is other than a predetermined highest brightness range (221-255) including predetermined highest brightness (value of brightness 255) and a predetermined lowest brightness range (0-69) including predetermined lowest brightness (value of brightness 0). Here, colors having a low brightness are excluded because color banding is less noticeable in colors approaching black, while colors having a high brightness are excluded because a small quantity of ink is used, making problems caused by superposed ink less likely. The second condition is that an angle $\theta=\tan^{-1}$ (Cb/Cr) (see FIG. 16) representing hue obtained by converting the RGB values of the target pixel falls outside the range 60-120 that includes yellow hues (in other words, the range excluding this yellow hue range). The control unit 21 may determine that the color values (RGB values) of the target pixel represent color which banding is noticeable without converting the RGB values into YCbCr values. That is, the control unit 21 determines whether the RGB values of the target pixel fall within a predetermined range in which the RGB values represent color other than yellow, and determines whether the RGB values of the target pixel fall within a range in which the ROB values represent brightness other than high brightness and low brightness.

If the control unit 21 determines in S103 that the color values of the target pixels meet both the first and second conditions, in S104 the control unit 21 determines whether the process in S105 described below has been completed for all representative pixels in the current detection block.

If the control unit 21 determines in S104 that the process has not been completed on all representative pixels in the target detection block (i.e., when one or more unprocessed representative pixels exist), the control unit 21 sets one of the unprocessed representative pixels to the target pixel and advances to S105. In S104 the control unit 21 sets the leftmost top representative pixel whose pixel values are acquired in S102, as a target pixel. However, since the pixel values of the leftmost top representative pixel is obtained and used in the following step S105 as reference values, the leftmost top representative pixel always gives a positive determination in step S105. So, in S104 the control unit 21 may skip to set the leftmost top representative pixel.

In S105 the control unit 21 determines whether the pixel values of the target pixel fall within a similar range to the reference values set in S102. Specifically, the control unit 21 determines that the pixels values of the target representative pixel fall in the similar range to the reference values when R2 falls in the range R1±α, G2 falls in the range G1±α, and B2 falls in the range B1±α, where (R1, G1, B1) are the reference values and (R2, G2, B2) are the pixel values of the target representative pixel. However, the method of determination is not limited to this method. For example, the control unit 21 may determine that the pixel values of the target pixel fall within a similar range to the reference values when a distance d between the reference values and the pixel values of the target pixel within the RGB color space ($\mathrm{sqrt}((R2-R1)^2+(G2-G1)^2+(B2-B1)^2)$) is less than or equal to a prescribed value, where sqrt( ) represents the square root operation.

The control unit 21 returns to S104 when determining in S105 that the pixel values of the target pixel fall within a similar range to the reference values and continues performing the determinations in S105 while there remain unprocessed representative pixels.

The control unit 21 advances to S106 after reaching positive determinations in S105 for all representative pixels in the detection block and determining in S104 that the process of S105 has been completed for all representative pixels in the detection block. In S106 the control unit 21 sets the recording operation for the next ($(N+1)^{th}$) scanning region following the target ($N^{th}$) scanning region to a special pass operation for recording in the same scanning direction used for the $N^{th}$ scanning region. Subsequently, the control unit 21 ends the current recording control process.

However, when the control unit 21 determines in S103 that at least one of the first and second conditions are not met or determines in S105 that pixel values for the target pixel do not fall within a similar range to the reference values, the control unit 21 returns to S101. In other words, the control unit 21 immediately stops processing a detection block upon determining that even one representative pixel in the detection block does not meet the conditions for pixels constituting a banding image. When there remain unprocessed detection blocks in S101, the control unit 21 performs the process from S102 on the next detection block. Hence, the control unit 21 moves the position of the detection block sequentially in the main scanning direction (by units equivalent to the horizontal width of the detection block), while performing determinations based on representative pixels in each detection block.

When determining in S101 that the process has been completed for all detection blocks within the target scanning region (i.e., when the process in S101-S105 has been performed for all detection blocks without setting the recording operation for the scanning region to the special pass operation), in S107 the control unit 21 sets the recording operation for the $(N+1)^{th}$ scanning region to a normal pass operation for recording in a different scanning direction that that for the $N^{th}$ scanning region. Subsequently, the control unit 21 ends the current recording control process.

1-4. Effects of the First Embodiment

According to the above described inkjet printer 2 of the first embodiment, the determinations of the existence of the banding image are made not for all pixels in the detection block but a part of pixels in the detection block. The process time of the recording control process that prevents the banding image from being formed is reduced. Further, at least one representative pixel is positioned at each X coordinate and at least one representative pixel is positioned at each Y coordinate in the area targeted for banding image detection. Accordingly, the potential for erroneous determinations are reduced.

The control unit 21 determines whether representative pixels have color values that fall within a similar range to the color values of the initial representative pixel, an image configured of a substantially the same color is detected as a banding image. Further, since the control unit 21 also determines whether the brightness of the representative pixel falls within a prescribed range and whether the hue of the pixel falls within a prescribed range that does not include yellow colors, the inkjet printer 2 can be prevented from identifying images in colors for which color banding is not obvious (yellow or black, for example) as banding images, even when the image is formed of substantially the same color. Accordingly, the recording speed does not suffer from excessively performing single-direction recording.

Further, by determining the presence of a banding image based solely on pixels within one scanning region, the inkjet printer 2 can quickly set the scanning direction for recording the scanning region. In a conceivable case when a device attempts to detect a banding image that covers a plurality of scanning regions, the device must buffer the plurality of scanning regions simultaneously, not only requiring a large amount of memory, but also lengthening the process time. However, since the inkjet printer 2 of the first embodiment detects the presence of a banding image based solely on pixels within a single scanning region, such issues with memory and process time can be avoided.

2. Second Embodiment

A communication system 100 according to a second embodiment has the same basic structure as the communication system 100 according to the first embodiment (see FIG. 1), but differs in the details of the recording control process executed on the inkjet printer 2. These points of difference will be described here.

In the first embodiment described above, the inkjet printer 2 divides a bordering area within a scanning region into a plurality of detection blocks of a prescribed reference size and determines that a banding image exists in the scanning region when all representative pixels within any one detection block satisfies the conditions of a pixel constituting a banding image.

Figure 17:
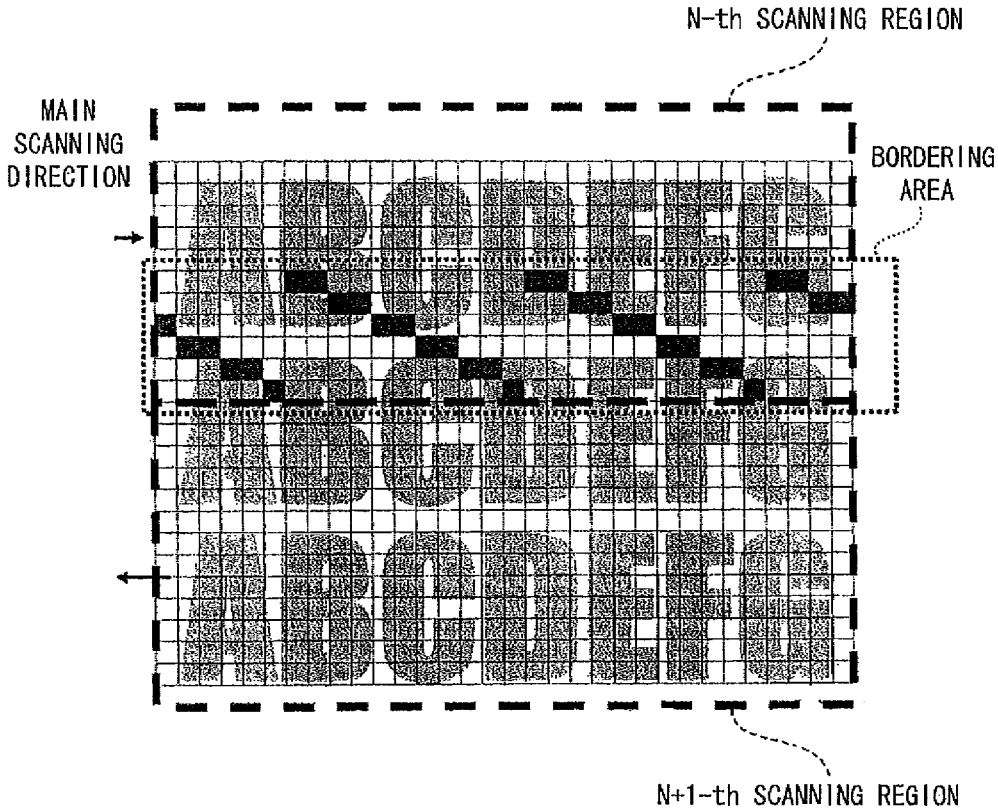
FIG. 17 is an explanatory diagram illustrating a determination method of a second embodiment.

However, the inkjet printer 2 according to the second embodiment does not divide the bordering area of the scanning region into detection blocks. As illustrated in FIG. 17, the inkjet printer 2 according to the second embodiment sequentially sets each representative pixel in the bordering area as the process target, beginning from the leftmost representative pixel and proceeding in the main scanning direction, and determines that a banding image exists in the scanning region when a number of consecutive representative pixels equal to or greater than a prescribed reference value meet the conditions of pixels constituting a banding image. In the embodiment, the representative pixels in the bordering area are arranged such that a pattern of the representative pixels in the detection block (FIGS. 14(*a*)-14(*c*), for example) in the first embodiment periodically appears in the main scanning direction. Especially, as shown in FIG. 17, the representative pixels are arranged along the plurality of lines that are parallel to each other and that pass the bordering area. That is, the pattern shown in FIG. 14(*a*) is used for arranging the representative pixels in the bordering area shown in FIG. 17.

Figure 18:
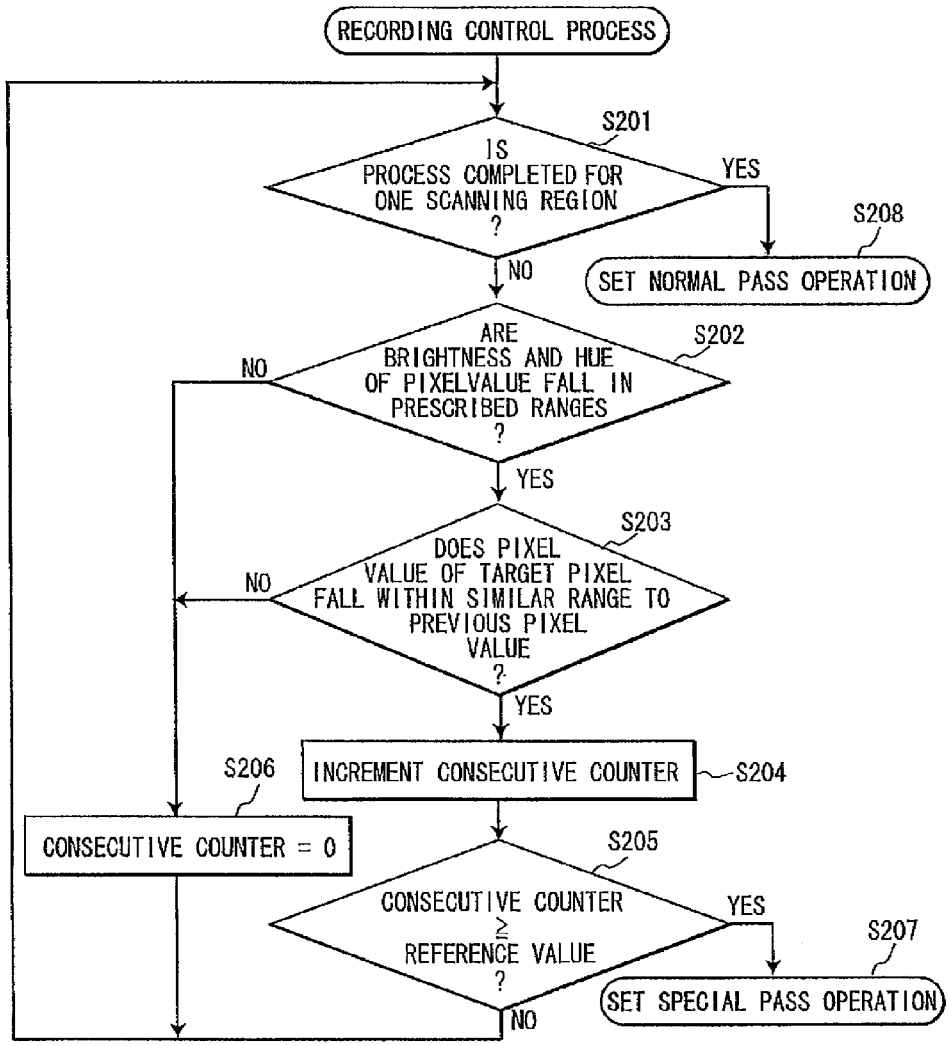
FIG. 18 is a flowchart illustrating steps in a recording control process according to a second embodiment.

FIG. 18 is a flowchart illustrating a recording control process executed by the control unit 21 instead of executing the recording control process shown in FIG. 14 of the first embodiment.

In S201 of the recording control process according to the second embodiment, the control unit 21 determines whether the process in S202-S206 described below has been completed for the entire targeted scanning region.

If the process has not been completed for the entire scanning region (i.e., if there exists one or more unprocessed representative pixels), the control unit 21 executes the process from S202 targeting one of the remaining unprocessed representative pixels. More specifically, the control unit 21 sets each representative pixel as the process target in order following the main scanning direction, beginning from the leftmost representative pixel. An order to target one of the unprocessed representative pixels are predetermined. In this case, the representative pixels are selected in the descending order of the X coordinate value of the representative pixel. Since, in the second embodiment, the representative pixels are arranged along one of the lines, two successively selected representative pixels arranged along one lines are adjacent each other, according to this order.

In S202 the control unit 21 determines whether the color values of the target pixel satisfy both the first and second conditions of a color for which banding is noticeable. Since this process is equivalent to the process of S103 in the recording control process of the first embodiment, a detailed description of this step will not be repeated.

When the control unit 21 determines in S202 that the color values of the target pixel meet both the first and second conditions, in S203 the control unit 21 determines whether the pixel value of the target pixel falls within a similar range to the pixel value of the pixel serving as the process target that is set immediately before the current representative pixel that is currently set as the target pixel (referred as previous target pixel). For example, similarly to the process in S105 of the first embodiment, the control unit 21 determine that the pixel values of the target pixel fall within a similar range to the reference values when a distance d between the pixel values of the previous target pixel and the pixel values of the current target pixel within the RGB color space. Here, the control unit 21 determines that the first representative pixel set as the process target falls within the similar range since no pixel has been targeted prior to the first representative pixel.

When the control unit 21 determines in S203 that the pixel value of the target representative pixel falls within a similar range to the previous pixel value, in S204 the control unit 21 increments a consecutive counter by "1" in order to count the number of consecutive representative pixels that meet the conditions of pixels constituting a banding image. Here, the consecutive counter is initialized to a value "0" when the recording control process is started.

In S205 the control unit 21 determines whether the value of the consecutive counter has reached the determination reference value (six, for example) for determining whether a banding image exists in the scanning region.

The control unit 21 returns to S201 and repeats the process described above upon determining in S205 that the value of the consecutive counter has not reached the determination reference value.

On the other hand, if the control unit 21 determines in S202 that the representative pixel did not meet at least one of the first and second conditions or if the control unit 21 determines in S203 that the pixel value of the representative pixel does not fall within a similar range to the pixel value of the previous target pixel, in S206 the control unit 21 resets the consecutive counter to "0" and returns to S201.

If the control unit 21 determines in S205 that the value of the consecutive counter has reached the determination reference value after repeating the process in S201-S206, in S207 the control unit 21 sets the recording operation for the next ($(N+1)^{th}$) scanning region following the currently targeted ($N^{th}$) scanning region to the special pass operation for recording in the same scanning direction as that used for the $N^{th}$ scanning region. Subsequently, the control unit 21 ends the recording control process.

On the other hand, if the control unit 21 determines in S201 that the process has been completed for the entire scanning region (i.e., when the process of S201-S206 has been performed on all representative pixels without the consecutive counter reaching the determination reference value), in S208 the control unit 21 sets the recording operation for the $(N+1)^{th}$ scanning region to the normal pass operation for recording in a different scanning direction from that used for the $N^{th}$ scanning region. Subsequently, the control unit 21 ends the recording control process.

As shown in FIG. 17, the representative pixels arranged along one line are apart from the representative pixels arranged along another line. If in S201 the control unit 21 sets the leftmost and top representative pixel among the representative pixels along one of line, that is, two successively set representative pixels are not adjacent each other, the control unit 21 may reset the consecutive counter to "0". By this operation, the representative pixels that give positive determinations in S202, and S203 are adjacent each other. In other words, in S027 the control unit 21 sets the recording operation for the $(N+1)^{th}$ scanning region to the special pass operation when the control unit 21 gives the positive determinations in S202 and S203 for the determination reference value (six in the embodiment) worth of the representative pixels that are continuously arranged.

The inkjet printer 2 according to the second embodiment described above obtains the same effects as the inkjet printer 2 according to the first embodiment.

The inkjet printer 2 according to the second embodiment can reduce the likelihood of erroneous determinations even more than the inkjet printer 2 according to the first embodiment, which requires that all representative pixels within each detection block meet the criteria. That is, when employing the method of the first embodiment, it is necessary to set detection blocks to a size that can fit within a banding image. However, even if the detection blocks were set smaller than the banding image, it is possible that the banding image would still not be detected if the detection block and banding image are offset such that a portion of the detection block extends beyond the banding image. On the other hand, if the detection blocks are set smaller than the reference size, images smaller than the reference size may be incorrectly identified as banding images. In contrast, the inkjet printer 2 according to the second embodiment can detect banding images included in the bordering area without setting detection blocks, thereby further reducing the likelihood of erroneous determinations.

3. Modifications

While the invention has been described in detail with reference to the embodiments thereof, it would be apparent to those skilled in the art that various changes and modifications may be made therein without departing from the spirit of the invention.

For example, in S203 of the second embodiment described above, the reference for the similar range is the pixel value of the previous process target. However, the reference for the similar range may be set to the pixel value of the representative pixel at the time the consecutive counter is changed from 0 to 1. By fixing the reference throughout the process of counting consecutive numbers in this way, it is possible to prevent the similar range from gradually shifting.

Further, while the detection blocks are set to a size equal to the reference size in the first embodiment described above, the detection blocks may be set to half the width of the reference size. In this case, the inkjet printer 2 can reliably detect banding images of a smaller size (a size approaching the reference size).

The inkjet printer 2 in the embodiments described above performs the recording control process on 256-level RGB data prior to performing color conversion on the data. However, the inkjet printer 2 may perform the recording control process on 256-level CMYK data that is produced through color conversion.

In the embodiments described above, when the inkjet printer 2 detects a banding image in the lower region of the $N^{th}$ scanning region on the border with the $(N+1)^{th}$ scanning region (i.e., the bordering area), the inkjet printer 2 controls recording so that the $(N+1)^{th}$ scanning region is scanned in the same direction as the $N^{th}$ scanning region, but the invention is not limited to this control. For example, when the inkjet printer 2 conversely detects a banding image in the upper area of the $N^{th}$ scanning region on the border with an $(N-1)^{th}$ scanning region, the inkjet printer 2 can control recording so that the $N^{th}$ scanning region is scanned in the same direction as the $(N-1)^{h}$ scanning region.

In the embodiments described above, the recording unit 26 is an inkjet device that records images using ink in the four colors C, M, Y, and K; but the invention may be applied to an inkjet recording device that employs a larger number of ink colors.

Further, the inkjet printer 2 serves as the recording control system of the invention in the embodiments described above, but the invention is not limited to this configuration. For example, the PC 1 (printer driver 123) may be configured to perform some or all of the process implemented by the recording control system of the invention.

What is claimed is:

1. A recording control system controlling an inkjet recording operation for recording an image by controlling a recording head based on image data indicating the image, the recording head having a plurality of nozzle rows and being configured to be capable of scanning in a first direction and a second direction opposite to the first direction, the plurality of nozzle rows corresponding to a plurality of colors, each nozzle row including a plurality of nozzles that are arranged in a direction intersecting with the first and second directions and that are configured to eject ink of corresponding color, the image including a plurality of pixels, the image data having a plurality of sets of pixel data corresponding to the plurality of pixels, each set of pixel data including a pixel value representing color of a corresponding pixel, the recording control system comprising:

a setting unit that sets, in the image, a first region and a second region adjacent to the first region, that sets a detection region in one of the first and second regions, and that sets a plurality of representative pixels in the detection region, the plurality of representative pixels being a part of the pixels in the detection region, a number of the plurality of representative pixels being smaller than a total number of the pixels existing in the detection region, a selecting unit that selects at least one representative pixel among the representative pixels;

a determining unit that determines whether a pixel value of the selected at least one representative pixel falls within a first pixel value range; and a control unit that controls the recording head to eject ink based on pixel data corresponding to pixels in the first region while controlling the recording head to scan in the first direction such that the recording head records the image in the first region, the control unit controlling the recording head to eject ink based on pixel data corresponding to pixels in the second region while controlling the recording head to scan in the first direction such that the recording head records the image in the second region when the determining unit determines that the pixel value of the selected at least one representative pixel falls within the first pixel value range, the control unit controlling the recording head to eject ink based on pixel data corresponding to pixels in the second region while controlling the recording head to scan in the second direction such that the recording head records the image in the second region when the determining unit determines that the pixel value of at least one of the selected at least one representative pixel does not falls within the first pixel value range, wherein the pixel value indicates a hue value representing hue of the color of the corresponding pixel and a brightness value representing brightness of the color of the corresponding pixel, wherein the determining unit determines that the pixel value of the selected at least one representative pixel falls within the first pixel value range when the determining unit determines that a first condition that a hue value falls within a predetermined hue range is satisfied for the selected at least one representative pixel and whether a second condition that a brightness value falls within a predetermined brightness range is satisfied for the selected at least one representative pixel, and wherein the determining unit determines that the pixel value of at least one of the selected at least one representative pixel does not falls within the first pixel value range when the determining unit determines that at least one of the first and the second condition is not satisfied for at least one of the representative pixels.

2. The recording control system according to claim 1, wherein the plurality of pixels are arranged in the image in an x direction and a y direction, the position of each pixel being defined by an x coordinate value with respect to the x direction and a y coordinate value with respect to the y direction, wherein the setting unit sets the detection region such that the x coordinate values and the y coordinate values of all the pixels in the detection region are in an x detection range and in a y detection range, respectively, wherein the setting unit sets the representative pixels in the detection region such that each x coordinate value in the x direction range is equal to the x coordinate value defining the position of at least one representative pixel and each y coordinate value in the y direction range is equal to the y coordinate value defining the position of at least one representative pixel.

3. The recording control system according to claim 1, wherein the representative pixels are arranged continuously in the detection region.

4. The recording control system according to claim 1, wherein the detection region is a rectangular shaped region, wherein the representative pixels are arranged continuously along a diagonal line defined in the rectangular shaped region.

5. The recording control system according to claim 1, wherein the detection region is a rectangular shaped region, wherein the representative pixels are arranged continuously along a pair of diagonal lines in the rectangular shaped region.

6. The recording control system according to claim 1, wherein the selecting unit selects one representative pixel among the representative pixels, wherein the determining unit further determines whether a third condition that a pixel value fall within a second pixel value range is satisfied for all of the representative pixels existing in the detection region, wherein the control unit controls the recording head to eject ink based on pixel data corresponding to pixels in the second region while controlling the recording head to scan in the first direction such that the recording head records the image in the second region when the determining unit determines that both of the first and second conditions are satisfied for the selected at least one representative pixel, and that the third condition is satisfied for all of the representative pixels existing in the detection region, the control unit controlling the recording head to eject ink based on pixel data corresponding to pixels in the second region while controlling the recording head to scan in the second direction such that the recording head records the image in the second region when the determining unit determines that at least one of the first, second condition is not satisfied for at least one of for the selected at least one representative pixel, and the third condition is not satisfied for at least one of the selected at least one representative pixel.

7. The recording control system according to claim 6, wherein the setting unit sets the second pixel value range based on the pixel value of the selected one representative pixel.

8. The recording control system according to claim 1, wherein the predetermined hue range is defined as a part of a predetermined entire hue range that is other than a predetermined yellow range.

9. The recording control system according to claim 1, wherein the predetermined brightness range is defined as a part of a predetermined entire brightness range that is other than a predetermined highest brightness range including predetermined highest brightness and a predetermined lowest brightness range including predetermined lowest brightness.

10. The recording control system according to claim 1, wherein the setting unit sets the first region, the second region, and the detection region in the image such that all of the first, second, and detection regions have rectangular shapes, one side of the detection region coinciding with a part of a border line between the first region and the second region.

11. The recording control system according to claim 1, wherein the setting unit sets the first region and the second region such that the first region and the second region are arranged in a direction orthogonal to the first and second directions.

12. The recording control system according to claim 1, wherein the selecting unit selects, among the plurality of representative pixels existing in the detection region, a plurality of representative pixels whose number is equal to a predetermined number smaller than the total number of the representative pixels existing in the detection region and which are arranged continuously with one another;

wherein the determining unit further determines whether the first and second conditions are satisfied for all the selected plurality of representative pixels, wherein the control unit controls the recording head to eject ink based on pixel data corresponding to pixels in the second region while controlling the recording head to scan in the first direction such that the recording head records the image in the second region when the determining unit determines that both of the first and second conditions are satisfied for all of the selected plurality of representative pixels, the control unit controlling the recording head to eject ink based on pixel data corresponding to pixels in the second region while controlling the recording head to scan in the second direction such that the recording head records the image in the second region when the determining unit determines that at least one of the first and second conditions are not satisfied for at least one of the selected plurality of representative pixels.

13. The recording control system according to claim 12, wherein the determining unit further determines whether a fourth condition that pixel values of each two adjacent pixels in the selected plurality of representative pixels are apart from each other by a value falling within a predetermined third pixel value range is satisfied, wherein the control unit controls the recording head to eject ink based on pixel data corresponding to pixels in the second region while controlling the recording head to scan in the first direction such that the recording head records the image in the second region when the determining unit determines that the first and second conditions are satisfied for the selected representative pixels and that the fourth condition is satisfied, the control unit controlling the recording head to eject ink based on pixel data corresponding to pixels in the second region while controlling the recording head to scan in the second direction such that the recording head records the image in the second region when the determining unit determines that at least one of the first and second conditions are not satisfied for at least one of the selected representative pixels or that the fourth condition is not satisfied.

* * * * *